US006991430B2

(12) United States Patent
Stec et al.

(10) Patent No.: US 6,991,430 B2
(45) Date of Patent: Jan. 31, 2006

(54) TURBINE BLADE WITH RECESSED SQUEALER TIP AND SHELF

(75) Inventors: Philip Francis Stec, Medford, MA (US); Daniel Edward Demers, Ipswich, MA (US); Richard Ludwig Schmidt, Marblehead, MA (US)

(73) Assignee: General Electric Company, Schenectady, NY (US)

( * ) Notice: Subject to any disclaimer, the term of this patent is extended or adjusted under 35 U.S.C. 154(b) by 51 days.

(21) Appl. No.: 10/408,293

(22) Filed: Apr. 7, 2003

(65) Prior Publication Data

US 2004/0197190 A1 Oct. 7, 2004

(51) Int. Cl.
*F01D 5/18* (2006.01)

(52) U.S. Cl. ..... 416/97 R; 415/115; 415/173.1; 416/92; 416/228

(58) Field of Classification Search ..... 415/115, 415/116, 173.1; 416/96 R, 97 R, 228, 92
See application file for complete search history.

(56) References Cited

U.S. PATENT DOCUMENTS 5,261,789 A * 11/1993 Butts et al. ..... 416/96 R
6,059,530 A 5/2000 Lee
6,164,914 A 12/2000 Correia et al.
6,190,129 B1 * 2/2001 Mayer et al. ..... 416/97 R
6,224,337 B1 5/2001 Lieland et al.
6,231,307 B1 * 5/2001 Correia ..... 416/97 R
6,333,121 B1 12/2001 Walston et al.
6,382,913 B1 5/2002 Lee et al.
6,422,821 B1 7/2002 Lee et al.
6,672,829 B1 * 1/2004 Cherry et al. ..... 416/97 R

* cited by examiner

*Primary Examiner*—Thomas E. Lazo
*Assistant Examiner*—Dwayne J White
(74) *Attorney, Agent, or Firm*—William Scott Andes; Steven J. Rosen

(57) ABSTRACT

A turbine blade squealer tip has a continuous squealer tip wall extending radially outwardly from and continuously around a tip cap. A recessed tip wall portion of the tip wall is recessed inboard from a pressure side of an airfoil outer wall of an airfoil of the blade forming a tip shelf therebetween. A plurality of film cooling shelf holes are disposed through the tip shelf to an internal cooling circuit of the blade and are spaced away from a junction between the recessed tip wall portion and the tip shelf. The exemplary embodiment of the airfoil includes shelf hole centerlines of the holes passing through pierce points in the shelf. At least a majority of the shelf hole centerlines are angled in outboard directions away from and outboard of the squealer tip wall. A majority of centerlines are angled away from vertical lines passing through the pierce points at first component angles in a range between 2 degrees and 16 degrees.

47 Claims, 6 Drawing Sheets

| HOLE # | FIRST COMPONENT ANGLE A | TIP ANGLE D | SECOND COMPONENT ANGLE B |
|---|---|---|---|
| H1 | 20.3977 | 12.7567 | 29.3687 |
| H2 | 21.3825 | 15.2956 | 21.4234 |
| H3 | 11.9122 | 19.3535 | 16.5204 |
| H4 | 13.9285 | 20.9224 | 21.5485 |
| H5 | 8.3494 | 20.7537 | 23.8746 |
| H6 | 3.2990 | 19.8185 | 24.8315 |
| H7 | 0.9128 | 18.7879 | 26.9887 |
| H8 | 1.4576 | 17.3683 | 32.0366 |
| H9 | 6.8371 | 15.8663 | 42.7619 |
| H10 | 5.3608 | 14.2892 | 27.4669 |
| H11 | 3.8516 | 12.6483 | 27.6512 |
| H12 | 2.3233 | 10.9462 | 27.7746 |
| H13 | 0.7769 | 9.1823 | 27.8368 |
| H14 | 1.4915 | 7.3560 | 27.8586 |
| H15 | 0.0051 | 5.5204 | 27.8873 |
| H16 | 0.9225 | 3.8140 | 28.0507 |
| H17 | 4.4375 | 2.4091 | 28.5497 |
| H18 | 8.0328 | 1.4545 | 29.7102 |
| H19 | 15.4522 | 1.1578 | 31.8316 |
| H20 | 23.6522 | 1.2317 | 35.5924 |
| H21 | 23.6874 | 1.2536 | 35.5753 |
| H22 | 27.5910 | 0.5391 | 33.2849 |
| H23 | 32.1082 | -0.0833 | 29.1212 |

FIG. 8

TURBINE BLADE WITH RECESSED SQUEALER TIP AND SHELF

GOVERNMENT INTERESTS

The U.S. Government may have certain rights in this invention in accordance with Contract No. N00019-96-C-0080 awarded by the Dept. of the Navy.

BACKGROUND OF THE INVENTION

1. Field of the Invention

The invention relates generally to gas turbine engine turbine blade squealer tip cooling and, more specifically, to turbine blade squealer tips cooled using cooling holes through a tip shelf.

2. Description of Related Art

Gas turbine engine turbine blades extract energy from hot combustion gas for powering the compressor and providing output power. Since the turbine blades are directly exposed to the hot combustion gas, they are typically provided with internal cooling circuits which channel a coolant, such as compressor bleed air, through the airfoil of the blade and through various film cooling holes around the surface thereof. One type of airfoil extends from a root at a blade platform, which defines the radially inner flowpath for the combustion gas, to a radially outer tip cap, and includes opposite pressure and suction sides extending axially from leading to trailing edges of the airfoil. The cooling circuit extends inside the airfoil between the pressure and suction sides and is bounded at its top by the airfoil tip cap. A squealer tip blade has a squealer tip wall extending radially outwardly from the top of the tip cap and completely around the perimeter of the airfoil on the tip cap to define a radially outwardly open tip cavity.

The squealer tip is a short radial extension of the airfoil wall and is spaced radially closely adjacent to an outer turbine shroud to provide a relatively small clearance gap therebetween for gas flowpath sealing purposes. Differential thermal expansion between the blade and the shroud, centrifugal loading, and radial accelerations cause the squealer tips to rub against the turbine shroud and abrade. Since the squealer tips extend radially above the tip cap, the tip cap itself and the remainder of the airfoil is protected from damage, which maintains integrity of the turbine blade and the cooling circuit therein.

However, since the squealer tips are solid metal projections of the airfoil, they are directly heated by the combustion gas which flows thereover. They are cooled by heat conduction with the heat then being removed by convection into the tip cap and cooling air injected into the cavity by passages through the tip. The cooling air from within the airfoil cooling circuit is used to convect heat away from tip and to inject into cavity. The squealer tip typically operates at temperatures above that of the remainder of the airfoil and can be a life limiting element of the airfoil in a hot turbine environment.

Since the pressure side of an airfoil typically experiences the highest heat load from the combustion gas, a row of conventional film cooling holes is typically provided in the pressure side of the airfoil outer wall immediately below the tip cap for providing a cooling film which flows upwardly over the pressure side of the squealer tip. U.S. Pat. No. 6,164,914 discloses a turbine blade including a hollow airfoil having a squealer tip wall extending outboard from a tip cap enclosing the airfoil. Film cooling holes extend through the junction of the tip cap below the pressure-side portion of the tip rib for discharging the coolant in a layer of film cooling air for flow along the exposed pressure side of the squealer tip wall. It is difficult to entrain the cooling air flow in a boundary layer along the exposed pressure side of the squealer tip wall. Often the film cooling holes will direct the cooling air to impinge on the pressure side of the squealer tip wall and a large portion will bounce off and not be entrained in the boundary layer.

However, cooling of the squealer wall is limited in effectiveness, and thermal gradients and stress therefrom are created which also affect blade life. The exposed squealer wall runs hotter than the airfoil sidewalls with the tip cap therebetween running cooler. Tip cooling must therefore be balanced against undesirable thermal gradients.

SUMMARY OF THE INVENTION

A turbine blade includes an airfoil having an airfoil outer wall extending longitudinally outwardly from a root, pressure side and suction sides extending laterally from a leading edge to a trailing edge of the airfoil, and a squealer tip at a radially outer end of the airfoil. The squealer tip includes a radially outer tip cap attached to the airfoil outer wall, a continuous squealer tip wall extending radially outwardly from and continuously around the tip cap forming a radially outwardly open tip cavity, and a recessed tip wall portion recessed inboard from the pressure side of the airfoil outer wall forming a tip shelf therebetween. An internal cooling circuit extends longitudinally outwardly from the root to the tip cap and a plurality of film cooling shelf holes are disposed through the tip shelf to the internal cooling circuit and spaced away from a junction between the recessed tip wall portion and the tip shelf.

In an exemplary of the turbine blade, the film cooling shelf holes have shelf hole centerlines passing through pierce points in the shelf angled at compound angles with respect to vertical lines passing through the pierce points. The compound angles have orthogonal first and second component angles. The first component angles lie in first planes defined by the vertical lines and first coordinate lines that are normal to the vertical lines and extend between the vertical lines and the recessed tip wall portion. The second component angles lie in second planes defined by the vertical lines and second coordinate lines that are normal to the vertical lines and normal to the first coordinate lines. At least a majority of the shelf hole centerlines are angled in outboard directions away from and outboard of the squealer tip wall. Their shelf hole centerlines are angled at the second component angles in downstream lateral directions with respect to vertical lines wherein the downstream lateral directions are normal to corresponding ones of the outboard directions and the vertical lines.

In a more particular embodiment of the turbine blade the first coordinate lines lie along transverse lines which are substantially shortest distances between the vertical lines are shortest distances between the vertical lines and the recessed tip wall portion. The shelf hole centerlines are spaced away from a fillet at the junction. The film cooling shelf holes extend into the fillet no more than 50 percent of a fillet width of the fillet as measured along the tip shelf. The majority of first component angles are in a range between 2 degrees and 16 degrees. A first plurality of the film cooling shelf holes have shelf hole centerlines with the positive first component angles in a range between 0.5 degrees and 5 degrees. The turbine blade is made with a nickel-base superalloy having a free sulfur content less than about 1 part per million by weight.

BRIEF DESCRIPTION OF THE DRAWINGS

The foregoing aspects and other features of the invention are explained in the following description, taken in connection with the accompanying drawings where:

FIG. 8 is a table of angles of tip film cooling holes illustrated in FIG. 1.

DETAILED DESCRIPTION OF THE INVENTION

Figure 1:
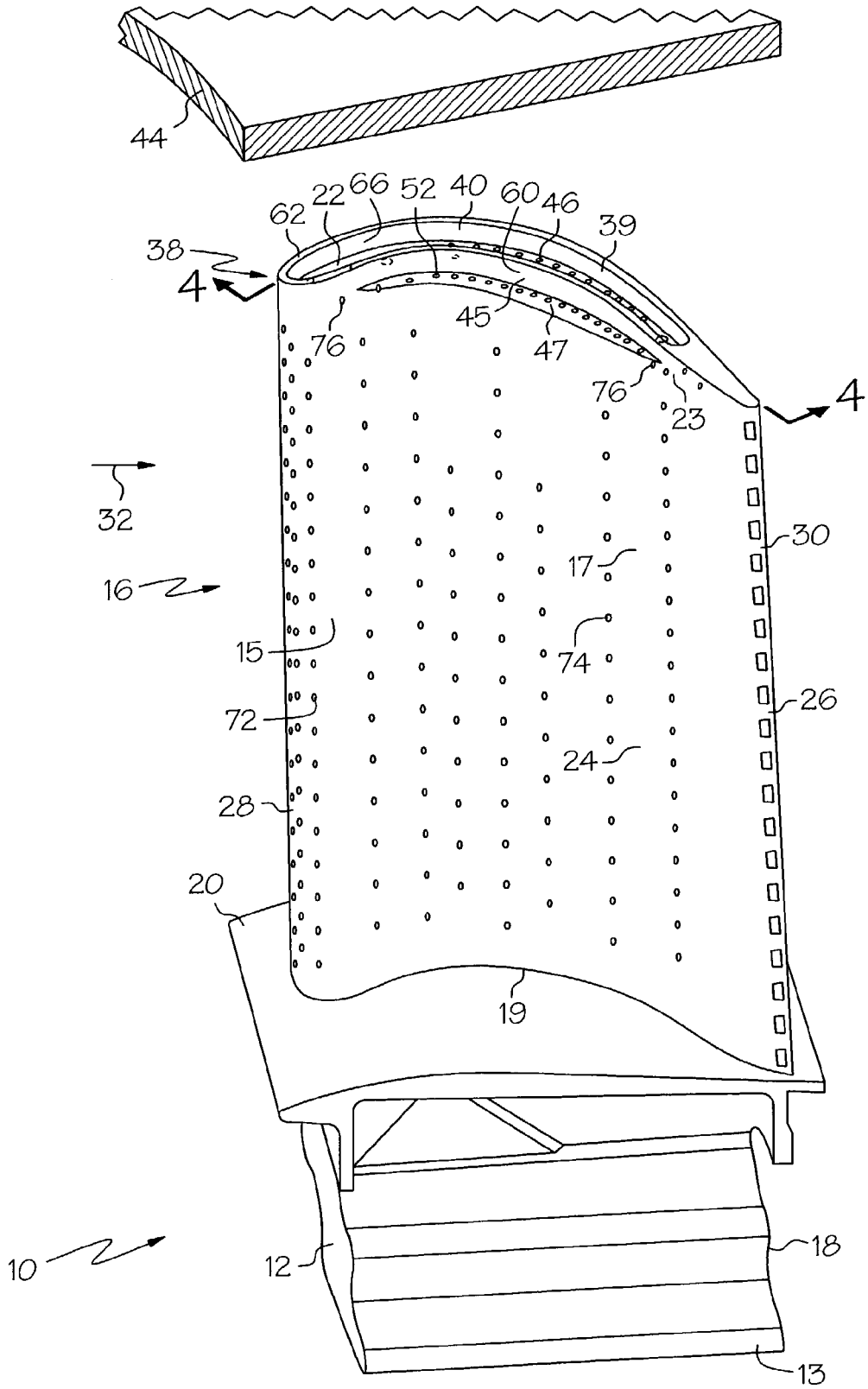
FIG. 1 is an isometric view illustration of an exemplary gas turbine engine turbine blade having a squealer blade tip with a tip shelf and film cooling shelf holes disposed through the tip shelf and spaced away from a tip wall.
Figure 2:
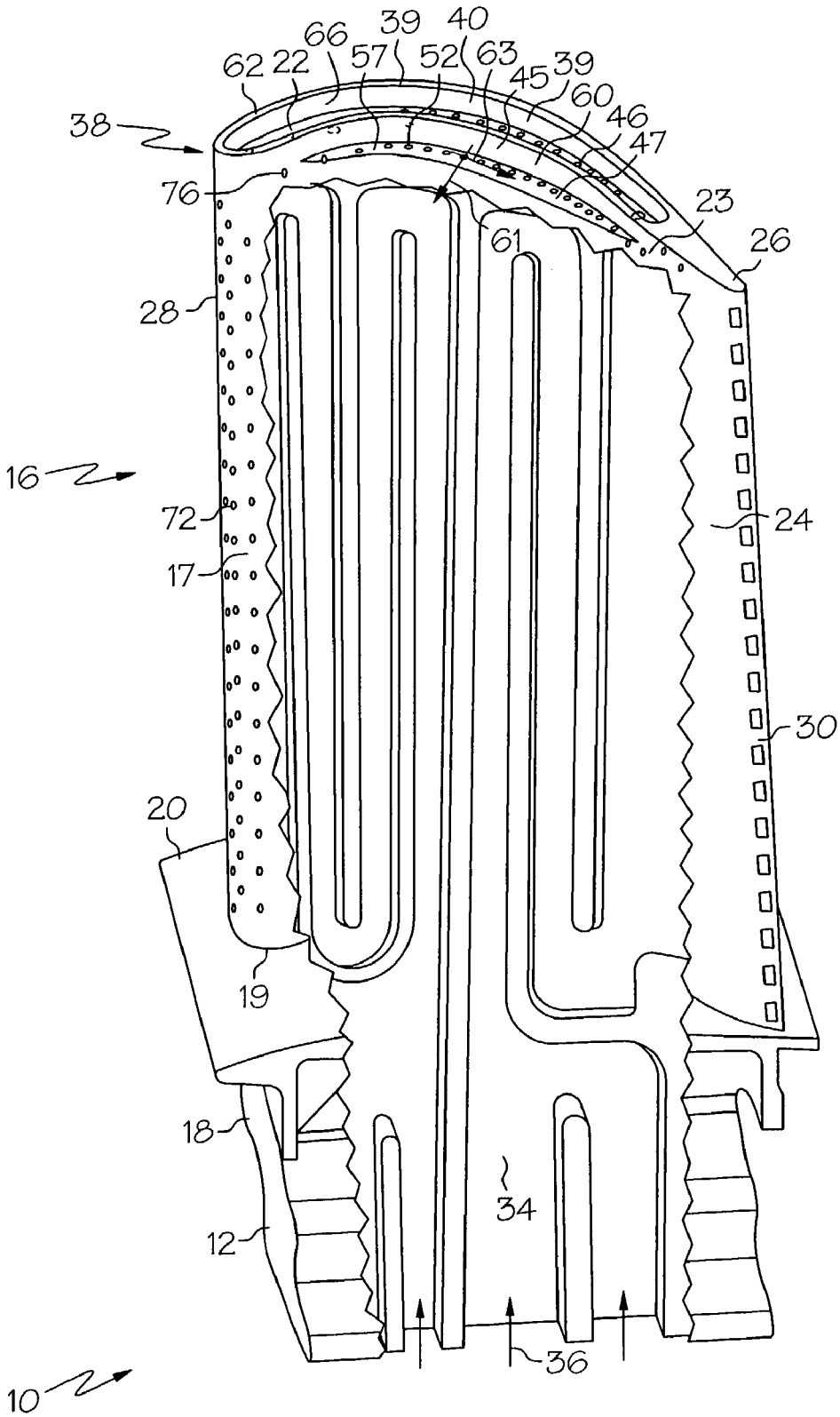
FIG. 2 is a partial cut-away illustration of the gas turbine engine turbine blade in FIG. 1.

Illustrated in FIGS. 1 and 2 is an exemplary gas turbine engine turbine rotor blade 10 configured for use as a first stage high pressure turbine blade. The blade 10 includes a dovetail 12 having suitable tangs 13 for mounting the blade in corresponding dovetail slots in the perimeter of a rotor disk (not shown). The blade 10 further includes an airfoil 16 joined to the dovetail 12 at an airfoil base 19 at an integral platform 20 and a squealer tip 38 at a radially outer end 23 of the airfoil. The squealer tip 38 includes an airfoil shaped squealer tip cap 22. The airfoil 16 further includes a continuous outer wall 15 with laterally opposite pressure and suction sides 24 and 26, respectively, extending longitudinally between a leading edge 28 and an opposite trailing edge 30 and radially from the airfoil base 19 to the tip cap 22. The airfoil is designed to withstand the deteriorating effects of a hot flowpath gas 32.

The airfoil 16 further includes an internal cooling channel or circuit 34 which extends from the tip cap 22 to the root and through the dovetail 12 for circulating or channeling a suitable coolant 36, such as air which may be bled from a conventional compressor (not shown) for cooling the blade 10. The internal cooling channel or circuit 34 is radially outwardly bound by the tip cap 22. The exemplary embodiment of the blade 10 is formed as a one-piece casting of the dovetail 12, airfoil 16, and platform 20 of a suitable high temperature metal such as nickel-base superalloys in a single crystal configuration which enjoys suitable strength at high temperature operation. A particular embodiment of the blade 10 is made of a more particular nickel-base superalloy having a free sulfur content less than about 1 part per million by weight (ppmw) which is disclosed in greater detail in U.S. Pat. No. 6,333,121. This low sulfur nickel-base superalloy (also referred to as N5) material helps reduce oxidation of the squealer tip 38.

The squealer tip 38 includes a continuous squealer tip wall 39 extending radially outwardly from and entirely around the airfoil shaped tip cap 22 along the pressure and suction sides 24 and 26, respectively, of the airfoil 16. The squealer tip wall 39 and tip cap 22 may be integrally formed or cast with the airfoil or be brazed or welded or otherwise attached to the airfoil. The squealer tip wall 39 extends around the tip cap 22 between laterally spaced apart leading and trailing edges 28 and 30 of the airfoil 16 to define a radially outwardly open tip cavity 40.

Figure 3:
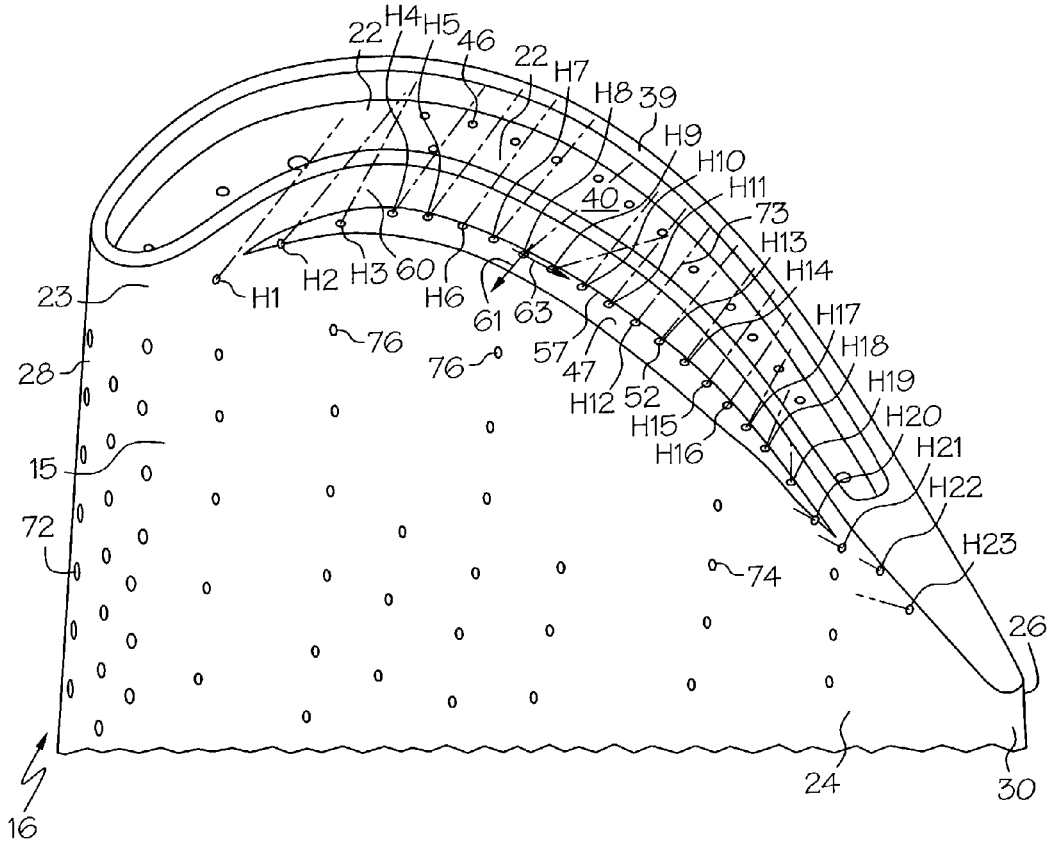
FIG. 3 is an enlarged isometric view illustration of the squealer blade tip and tip shelf illustrated in FIG. 1.
Figure 4:
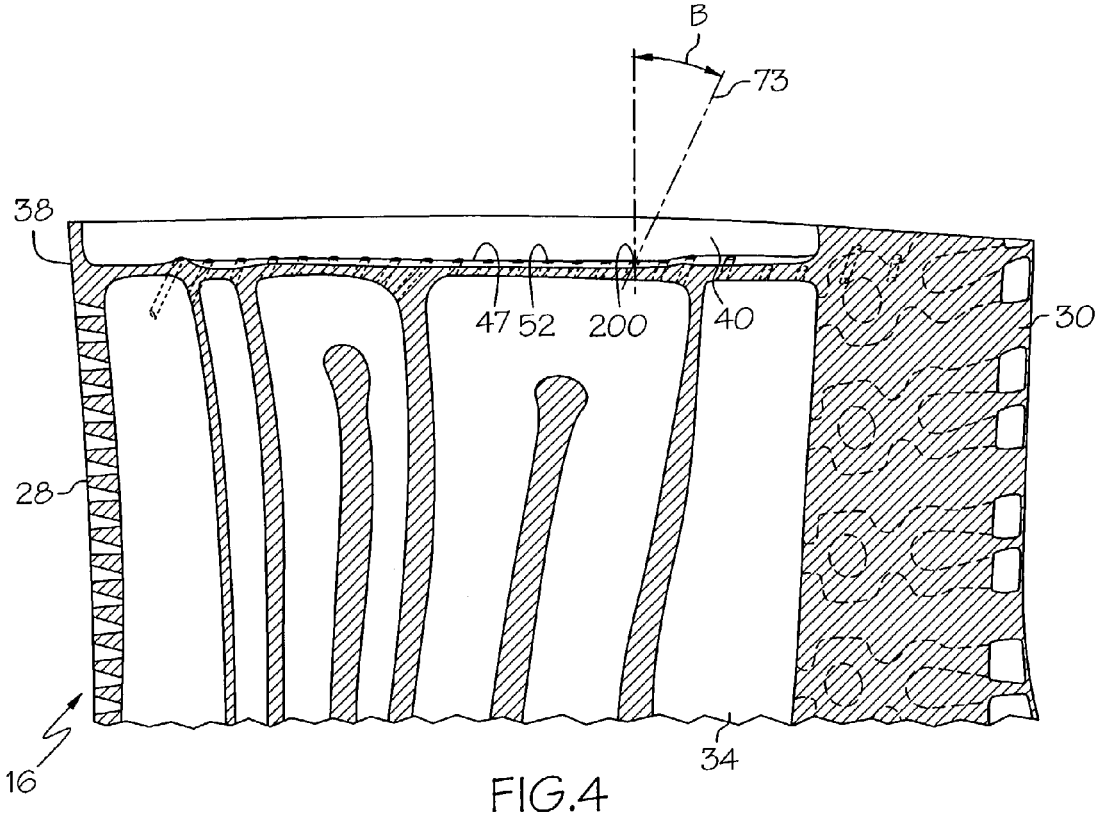
FIG. 4 is a cross-sectional view illustration through 4—4 in FIG. 1 and through tip shelf illustrated in FIG. 1.
Figure 5:
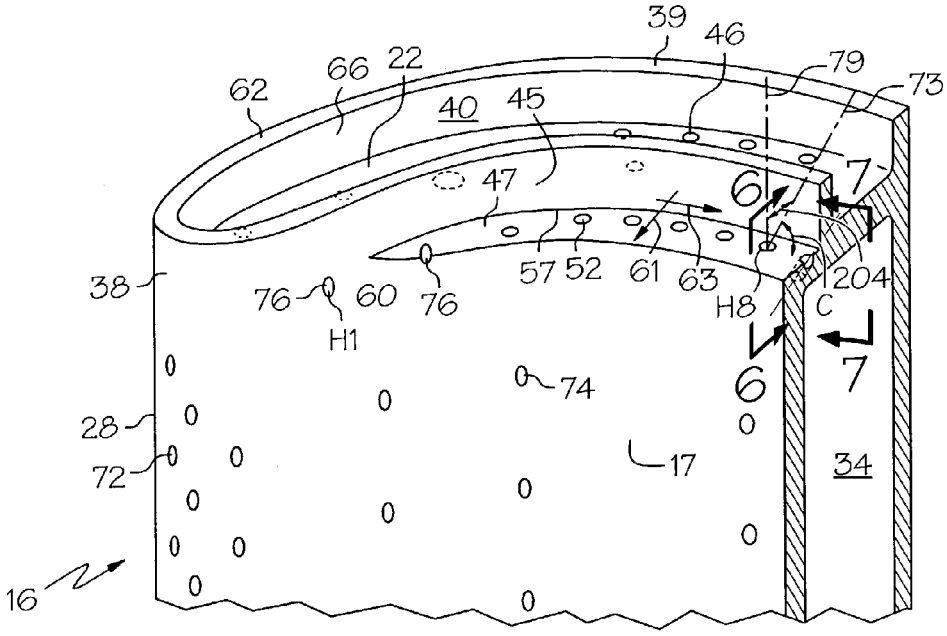
FIG. 5 is an enlarged cut-away isometric view illustration of a portion of the squealer blade tip and tip shelf illustrated in FIG. 1.

Further referring to FIGS. 3–5, a recessed tip wall portion 45 is recessed inboard from the pressure side 24 of the airfoil outer wall 15 forming a tip shelf 47 between the recessed tip wall portion 45 and the pressure side 24 of the airfoil outer wall 15. Thus the internal cooling circuit 34 is bounded in part by the recessed tip wall portion. A plurality of film cooling shelf holes 52 are disposed through the tip shelf 47 to the internal cooling circuit 34. The shelf holes 52 are spaced away from a junction 57 between the recessed tip wall portion 45 and the tip shelf 47. The shelf hole centerlines 73 are spaced away from a fillet 59 having a fillet radius R at the junction 57. The film cooling shelf holes 52 may extend into the fillet no more than 50 percent of a fillet width W of the fillet as measured along the tip shelf 47 from the end of the fillet to the recessed tip wall portion 45. The location of the film cooling shelf holes 52 away from the recessed tip wall portion 45 reduces or avoids crack initiation. The exemplary embodiment of the turbine blade is designed to have between 18 and 23 shelf holes 52 each having a hole diameter DH in a range of about 14–18 mils (0.014–0.018 inches).

Figure 6:
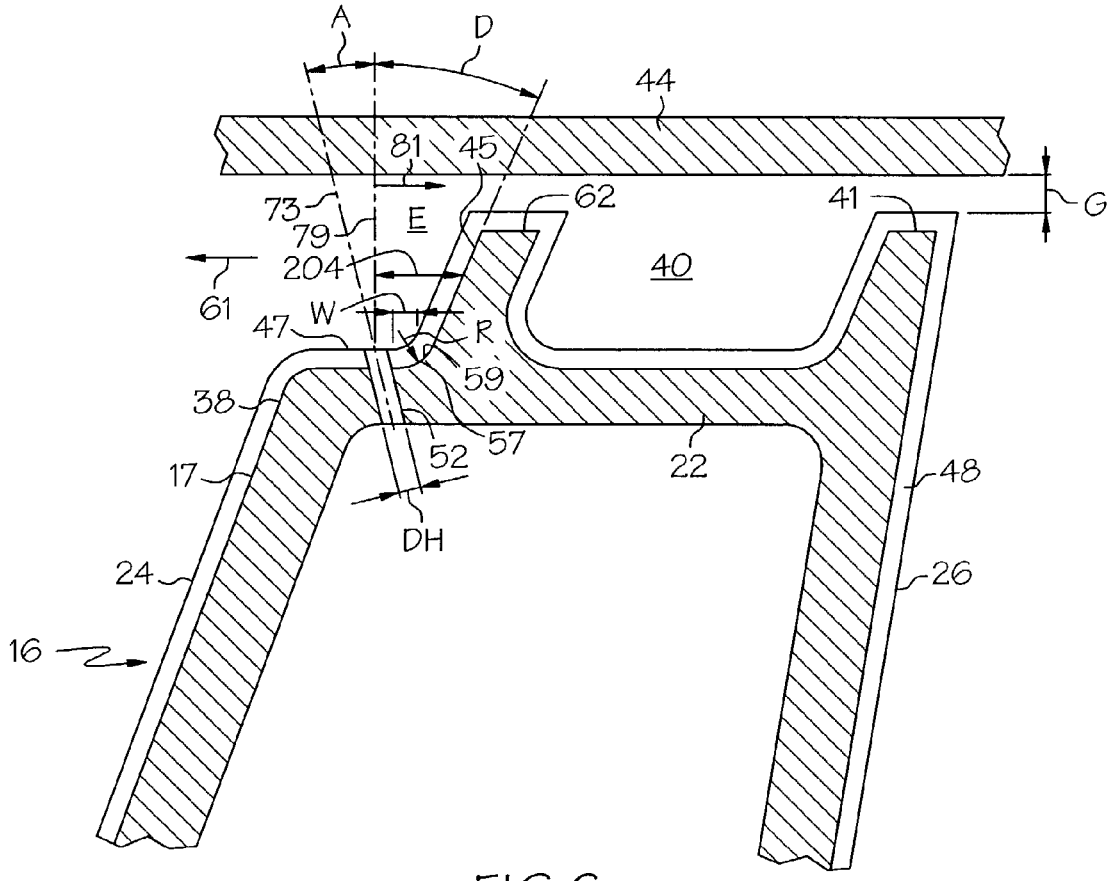
FIG. 6 is a cross-sectional view illustration through 6—6 in FIG. 5.
Figure 7:
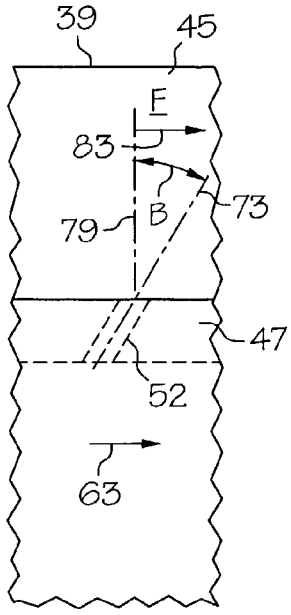
FIG. 7 is a cross-sectional view illustration through 7—7 in FIG. 5.

Further referring to FIGS. 6–7, the film cooling shelf holes 52 have shelf hole centerlines 73 passing through pierce points 200 in the shelf 47 and angled at compound angles C with respect to the vertical lines 79 passing through the pierce points 200. The compound angles C have orthogonal first and second component angles A and B. The first component angles A lie in first planes E defined by the vertical lines 79 and first coordinate lines 81, normal to the vertical lines 79, between the vertical lines 79 and the recessed tip wall portion 45. The second component angles B lie in second planes F defined by the vertical lines 79 and second coordinate lines 83 that are normal to the vertical lines 79 and normal to first coordinate lines 81. In the exemplary embodiment of the blade 10 illustrated herein the first coordinate lines 81 lie along transverse lines which are substantially shortest distances 204 between the vertical lines 79 and the recessed tip wall portion 45.

A majority of the film cooling shelf holes 52 have shelf hole centerlines 73 have positive first component angles A and which point in generally outboard directions 61 away from and outboard of the squealer tip wall 39. Thus, the majority of the shelf hole centerlines 73 are angled in outboard directions 61 away from and outboard of the squealer tip wall 39. The shelf hole centerlines 73 are angled at the second angles B in downstream lateral directions 63 with respect to vertical lines 79 and the downstream lateral directions 63 are normal to corresponding ones of the outboard directions 61.

Referring to exemplary Table 1 illustrated in FIG. 8, the exemplary embodiment of the blade 10 has 23 tip wall film cooling holes H1–H23 of which H4–H19 are the film cooling shelf holes 52. The tip wall film cooling holes H1–H23 are used to film cool the pressure side 24 of the airfoil outer wall 15 including the recessed tip wall portion 45. The shelf hole centerlines 73 of the film cooling shelf holes 52 have positive first component angles A in a range between O degrees and 16 degrees. The tip wall film cooling holes H3–H6, H9–H12, and H17–H18 illustrate a majority of the film cooling shelf holes 52 having shelf hole centerlines 73 with the positive first component angles A between 2 degrees and 16 degrees. The tip wall film cooling holes H6–H8, H11–H14, and H16–H17 illustrate a plurality of the film cooling shelf holes 52 having shelf hole centerlines 73 with the positive first component angles A between 0.5 degrees and 5 degrees. The pressure side 24 of the airfoil outer wall 15 including the recessed tip wall portion 45 is angled away from the shelf hole centerlines 73 in inboard directions at tip angles D as illustrated in FIGS. 1 and 6 and Table 1. The positive first component angles A of the shelf hole centerlines 73 of the film cooling shelf holes 52 direct the cooling air to be entrained in the boundary layer and not impinge on the pressure side of the squealer tip wall so as to cause a large portion of the cooling air to bounce off the wall and not be entrained in the boundary layer.

Referring to FIGS. 1 and 6, an external surface 17 of the outer wall 15 of airfoil 16 is film cooled by flowing cooling air through leading edge shower head cooling holes 72 and downstream angled film cooling airfoil holes 74 along the outer wall 15. The tip wall film cooling holes H1–H2 and H20–23 are radially outwardly angled shaped cooling holes 76 disposed through the pressure side 24 of the airfoil 16 immediately below the tip cap 22 for flowing cooling air radially outwardly along an outboard side 60 of squealer tip wall 39. The squealer tip wall 39 includes a flat top 62 for maintaining a relatively small radial gap G between the tip wall and a turbine shroud 44 for reducing leakage of the flowpath gas 32 therebetween during operation. During portions of the engine's operation, the squealer tip wall 39 will rub against the shroud 44 protecting the remainder of the airfoil 16 and tip cap 22 from damage. This will cause an acceptable and planned amount of cracking in the tip wall 39 which is periodically replaced during overhauls. A plurality of chordally spaced apart tip cap supply holes 46 extend radially through the tip cap 22 in flow communication with the cooling circuit 34 inside the airfoil 16 for channeling respective portions of the coolant 36 therefrom and into the tip cavity 40 for cooling the tip, the cavity, and inboard side 66 of the tip wall 39 by convection. The tip cap supply holes 46 are located near the tip wall 39 along the suction side 26 of the continuous outer wall 15 to help purge the cavity 40 of hot gases and cool the tip wall 39.

Illustrated in FIG. 6 is a thermal barrier coating (TBC) 48 which coats the entire inner surface bounding the tip cavity 40 along inboard side 66 of the squealer tip wall 39, a radially outwardly facing surface 41 of the tip cap 22 within the squealer tip wall 39, the flat top 62, the outboard side 60, and the external surface 17 of the airfoil 16 along both the pressure and suction sides 24 and 26, respectively, from the root 18 to the squealer tip 38. The TBC coatings may be of any well known and conventional composition, such as yttria stabilized zirconia, which is a thermally insulating ceramic material. The thermal barrier coating (TBC) inside and outside the tip cavity 40 and on the tip cap 22 and the flat top 62 of the squealer tip wall 39 insulates the squealer tip 38 from hot gas ingestion and spikes in temperature during engine transients.

The present invention has been described in an illustrative manner. It is to be understood that the terminology which has been used is intended to be in the nature of words of description rather than of limitation. While there have been described herein, what are considered to be preferred and exemplary embodiments of the present invention, other modifications of the invention shall be apparent to those skilled in the art from the teachings herein and, it is, therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A turbine blade comprising:

an airfoil including an airfoil outer wall extending longitudinally outwardly from a root, pressure side and suction sides extending laterally from a leading edge to a trailing edge of the airfoil, a squealer tip at a radially outer end of the airfoil, the squealer tip including a radially outer tip cap attached to the airfoil outer wall, a continuous squealer tip wall extending radially outwardly from and continuously around the tip cap forming a radially outwardly open tip cavity, a recessed tip wall portion recessed inboard from the pressure side of the airfoil outer wall forming a tip shelf therebetween, an internal cooling circuit extending longitudinally outwardly from the root to the tip cap bounded in part by the recessed tip wall portion, and a plurality of film cooling shelf holes disposed through the tip shelf and extending through the recessed tip wall portion directly into the internal cooling circuit and spaced away from a junction between the recessed tip wall portion and the tip shelf.

2. A turbine blade as claimed in claim 1, further comprising:

the film cooling shelf holes having shelf hole centerlines passing through pierce points in the shelf angled at compound angles with respect to vertical lines passing through the pierce points, the compound angles have orthogonal first and second component angles, the first component angles lie in first planes defined by the vertical lines and first coordinate lines that are normal to the vertical lines and extend between the vertical lines and the recessed tip wall portion, the second component angles lie in second planes defined by the vertical lines and second coordinate lines that are normal to the vertical lines and normal to the first coordinate lines, and at least a majority of the shelf hole centerlines are angled in outboard directions away from and outboard of the squealer tip wall.

3. A turbine blade as claimed in claim 2, further comprising the shelf hole centerlines being angled at the second component angles in downstream lateral directions with respect to vertical lines wherein the downstream lateral directions are normal to corresponding ones of the outboard directions and the vertical lines.

4. A turbine blade as claimed in claim 2, wherein the first component angles lie in first planes defined by the vertical lines and transverse lines which are shortest distances between the vertical lines and the recessed tip wall portion.

5. A turbine blade as claimed in claim 3, further comprising the shelf hole centerlines being spaced away from a fillet at the junction.

6. A turbine blade as claimed in claim 5, further comprising the film cooling shelf holes extending into the fillet no more than 50 percent of a fillet width of the fillet as measured along the tip shelf.

7. A turbine blade as claimed in claim 6, wherein the first component angle lies in first planes defined by the vertical lines and transverse lines which are shortest distances between the vertical lines and the recessed tip wall portion.

8. A turbine blade as claimed in claim 2, wherein the majority of first component angles are in a range between 2 degrees and 16 degrees.

9. A turbine blade as claimed in claim 8, further comprising a first plurality of the film cooling shelf holes having shelf hole centerlines with the positive first component angles in a range between 0.5 degrees and 5 degrees.

10. A turbine blade as claimed in claim 2, further comprising the pressure side of the airfoil outer wall including the recessed tip wall portion being angled away from the shelf hole centerlines in an inboard direction.

11. A turbine blade as claimed in claim 10, wherein the first component angles are in a range between 2 degrees and 16 degrees.

12. A turbine blade as claimed in claim 11, further comprising a first plurality of the film cooling shelf holes having shelf hole centerlines with the positive first component angles in a range between 0.5 degrees and 5 degrees.

13. A turbine blade as claimed in claim 2, further comprising the turbine blade made with a nickel-base superalloy having a free sulfur content less than about 1 part per million by weight.

14. A turbine blade as claimed in claim 13, further comprising the shelf hole centerlines being angled at the second component angles in downstream lateral directions with respect to vertical lines wherein the downstream lateral directions are normal to corresponding ones of the outboard directions and the vertical lines.

15. A turbine blade as claimed in claim 13, wherein the first component angles lie in first planes defined by the vertical lines and transverse lines which are shortest distances between the vertical lines and the recessed tip wall portion.

16. A turbine blade as claimed in claim 14, further comprising the shelf hole centerlines being spaced away from a fillet at the junction.

17. A turbine blade as claimed in claim 16, further comprising the film cooling shelf holes extending into the fillet no more than 50 percent of a fillet width of the fillet as measured along the tip shelf.

18. A turbine blade as claimed in claim 17, wherein the first component angle lies in first planes defined by the vertical lines and transverse lines which are shortest distances between the vertical lines and the recessed tip wall portion.

19. A turbine blade as claimed in claim 13, wherein the majority of first component angles are in a range between 2 degrees and 16 degrees.

20. A turbine blade as claimed in claim 19, further comprising a first plurality of the film cooling shelf holes having shelf hole centerlines with the positive first component angles in a range between 0.5 degrees and 5 degrees.

21. A turbine blade as claimed in claim 13, further comprising the pressure side of the airfoil outer wall including the recessed tip wall portion being angled away from the shelf hole centerlines in an inboard direction.

22. A turbine blade as claimed in claim 21, wherein the first component angles are in a range between 2 degrees and 16 degrees.

23. A turbine blade as claimed in claim 22, further comprising a first plurality of the film cooling shelf holes having shelf hole centerlines with the positive first component angles in a range between 0.5 degrees and 5 degrees.

24. A turbine blade as claimed in claim 2, further comprising a thermal barrier coating on inboard and outboard sides of the squealer tip wall, a radially outwardly facing surface of the tip cap within the squealer tip wall, and a flat top of the squealer tip wall.

25. A turbine blade as claimed in claim 24, further comprising the turbine blade made with a nickel-base superalloy having a free sulfur content less than about 1 part per million by weight.

26. A turbine blade as claimed in claim 25, further comprising the shelf hole centerlines being angled at the second component angles in downstream lateral directions with respect to vertical lines wherein the downstream lateral directions are normal to corresponding ones of the outboard directions and the vertical lines.

27. A turbine blade as claimed in claim 26, wherein the first component angles lie in first planes defined by the vertical lines and transverse lines which are shortest distances between the vertical lines and the recessed tip wall portion.

28. A turbine blade as claimed in claim 27, further comprising the shelf hole centerlines being spaced away from a fillet at the junction.

29. A turbine blade as claimed in claim 28, further comprising the film cooling shelf holes extending into the fillet no more than 50 percent of a fillet width of the fillet as measured along the tip shelf.

30. A turbine blade as claimed in claim 29, wherein the majority of first component angles are in a range between 2 degrees and 16 degrees.

31. A turbine blade as claimed in claim 30, further comprising a first plurality of the film cooling shelf holes having shelf hole centerlines with the positive first component angles in a range between 0.5 degrees and 5 degrees.

32. A turbine blade as claimed in claim 25, further comprising a plurality of chordally spaced apart tip cap supply holes extending radially through the tip cap from the cooling circuit into the tip cavity, the tip cap supply holes being located near the tip wall along the suction side of the continuous outer wall.

33. A turbine blade as claimed in claim 32, further comprising the shelf hole centerlines being angled at the second component angles in downstream lateral directions with respect to vertical lines wherein the downstream lateral directions are normal to corresponding ones of the outboard directions and the vertical lines.

34. A turbine blade as claimed in claim 33, wherein the first component angles lie in first planes defined by the vertical lines and transverse lines which are shortest distances between the vertical lines and the recessed tip wall portion.

35. A turbine blade as claimed in claim 34, further comprising the shelf hole centerlines being spaced away from a fillet at the junction.

36. A turbine blade as claimed in claim 35, further comprising the film cooling shelf holes extending into the fillet no more than 50 percent of a fillet width of the fillet as measured along the tip shelf.

37. A turbine blade as claimed in claim 36, wherein the majority of first component angles are in a range between 2 degrees and 16 degrees.

38. A turbine blade as claimed in claim 37, further comprising a first plurality of the film cooling shelf holes having shelf hole centerlines with the positive first component angles in a range between 0.5 degrees and 5 degrees.

39. A turbine blade as claimed in claim 24, further comprising the film cooling shelf holes having hole diameters in a range of about 14–18 mils.

40. A turbine blade as claimed in claim 39, further comprising the shelf hole centerlines being angled at the second component angles in downstream lateral directions with respect to vertical lines wherein the downstream lateral directions are normal to corresponding ones of the outboard directions and the vertical lines.

41. A turbine blade as claimed in claim 40, wherein the first component angles lie in first planes defined by the vertical lines and transverse lines which are shortest distances between the vertical lines and the recessed tip wall portion.

42. A turbine blade as claimed in claim 41, further comprising the shelf hole centerlines being spaced away from a fillet at the junction.

43. A turbine blade as claimed in claim 41, further comprising the film cooling shelf holes extending into the fillet no more than 50 percent of a fillet width of the fillet as measured along the tip shelf.

44. A turbine blade as claimed in claim 43, wherein the majority of first component angles are in a range between 2 degrees and 16 degrees.

45. A turbine blade as claimed in claim 44, further comprising a first plurality of the film cooling shelf holes having shelf hole centerlines with the positive first component angles in a range between 0.5 degrees and 5 degrees.

46. A turbine blade as claimed in claim 45, further comprising the turbine blade made with a nickel-base superalloy having a free sulfur content of less than about 1 part per million by weight.

47. A turbine blade as claimed in claim 46, further comprising a plurality of chordally spaced apart tip cap supply holes extending radially through the tip cap from the cooling circuit into the tip cavity, the tip cap supply holes being located near the tip wall along the suction side of the continuous outer wall.

* * * * *